US007077079B2

(12) United States Patent
Matsuo

(10) Patent No.: US 7,077,079 B2
(45) Date of Patent: Jul. 18, 2006

(54) CYLINDER BLOCK OF INTERNAL COMBUSTION ENGINE

(75) Inventor: Kazunori Matsuo, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/959,577

(22) Filed: Oct. 7, 2004

(65) Prior Publication Data

US 2005/0076861 A1 Apr. 14, 2005

(30) Foreign Application Priority Data

Oct. 10, 2003 (JP) ..... 2003-351586

(51) Int. Cl.
*F02B 75/18* (2006.01)

(52) U.S. Cl. ..... 123/41.74; 123/41.72; 123/195 R

(58) Field of Classification Search ..... 123/41.74, 123/41.72, 195 R
See application file for complete search history.

(56) References Cited

U.S. PATENT DOCUMENTS

| | | | | |
|---|---|---|---|---|
| 4,237,847 | A | 12/1980 | Baugh et al. | |
| 4,515,112 | A | 5/1985 | Tsuchiya et al. | |
| 4,712,517 | A | 12/1987 | Anno et al. | |
| 5,253,615 | A * | 10/1993 | Heater et al. | 123/41.74 |
| 6,295,954 | B1 | 10/2001 | Suzuki | |

FOREIGN PATENT DOCUMENTS

| | | |
|---|---|---|
| JP | 6-299900 A | 10/1994 |
| JP | 2000-291488 A | 10/2000 |

* cited by examiner

*Primary Examiner*—Tony M. Argenbright
*Assistant Examiner*—Katrina Harris
(74) *Attorney, Agent, or Firm*—Foley & Lardner LLP

(57) ABSTRACT

A reinforcing structure is integrally formed on a front wall of a cylinder block of shallow water jacket type. The reinforcing structure comprises mutually crossing vertical and lateral ribs. The vertical rib extends vertically between upper and lower deck portions of the cylinder block, and the lateral rib is constructed to constitute a raised ridge of a front one of jacket bottom wall. Alternatively, the reinforcing structure comprises a raised bolt boss that is integrally formed on a front one of jacket bottom walls to catch a connecting bolt used for securing a middle portion of a front cover to the front wall.

11 Claims, 3 Drawing Sheets

CYLINDER BLOCK OF INTERNAL COMBUSTION ENGINE

BACKGROUND OF THE INVENTION

1. Field of the Invention

The present invention relates in general to cylinder blocks of an internal combustion engine, and more particularly to the cylinder blocks of a so-called shallow bottom water jacket type wherein a bottom of a water jacket surrounding each cylinder is positioned above a lower deck portion of the cylinder block.

2. Description of the Related Art

Japanese Laid-open Patent Application (Tokkaihei) 6-299900 and Japanese Laid-open Patent Application 2000-291488 disclose cylinder blocks of the shallow bottom water jacket type, for an internal combustion engine. In these cylinder blocks, around each cylinder wall, there extends a jacket side wall to define therebetween a water jacket, so that under operation of the engine, cooling water is forced to flow in the water jacket to absorb heat of the cylinder wall. A lower end of the jacket side wall is connected to the cylinder wall through a jacket bottom wall. The jacket bottom wall is positioned above a lower deck portion of the cylinder block. As is known, the lower deck portion of the cylinder block is the portion from which a crank case extends downward.

With the shallow bottom water jacket, an upper part of the cylinder wall near the combustion chamber is effectively cooled by cooling water and due to absence of water jacket around the lower end of the cylinder wall, weight reduction of the cylinder block is possible accordingly. The above-mentioned published patent applications describe various advantages that are induced by such shallow bottom water jacket construction, which are for example, suppression of over cooling, improvement in fuel consumption, improvement in exhaust characteristics, improvement in heating characteristics of heating system, etc.,.

SUMMARY OF THE INVENTION

However, it has been revealed that due to its inherent construction of the shallow bottom water jacket, the jacket bottom wall of the cylinder block, particularly, the jacket bottom wall near a front wall of the cylinder block tends to receive a big stress under operation of the engine. That is, the jacket bottom wall of such position is attacked by a stress concentration. If the stress concentration is abnormally high, it would bring about a deformation of the cylinder wall and thus that of the front wall.

Accordingly, it is an object of the present invention to provide a cylinder block of shallow bottom water jacket type, which has a satisfied rigidity against a stress concentration.

That is, it is an object of the present invention to provide a cylinder block of a shallow bottom water jacket type, wherein a jacket bottom wall near a front wall can exhibit a high rigidity against such stress concentration.

It is another object of the present invention to provide a cylinder block of a shallow bottom water jacket type, which is constructed to suppress or at least minimize vibration of a front cover that is fixed to the front wall of the cylinder block.

In accordance with a first aspect of the present invention, there is provided a cylinder block of an internal combustion engine, which comprises an upper deck portion on which a cylinder head is to be mounted; a lower deck portion from which a crank case extends downward; aligned cylinder walls each extending vertically between the upper and lower deck portions, the cylinder walls having cylinder bores defined therein respectively; jacket side walls respectively surrounding the cylinder walls so that a water jacket is defined between each jacket side wall and the corresponding cylinder wall; jacket bottom walls each extending between a vertically lowermost end of each jacket side wall and a vertically middle part of the corresponding cylinder wall, the jacket bottom walls being positioned above the lower deck portion; a front wall that constitutes an axial end wall of the cylinder block, the front wall being integral with a front part of the upper deck portion, a front part of the lower deck portion, a front one of the cylinder walls, a front one of the jacket side walls and a front one of the jacket bottom walls; and a reinforcing structure integrally formed on the front wall for reinforcing an entire construction of the cylinder block, the reinforcing structure being of a type that is raised from a major surface of the front wall.

In accordance with a second aspect of the present invention, there is provided a cylinder block of an internal combustion engine, which comprises an upper deck portion on which a cylinder head is to be mounted; a lower deck portion from which a crank case extends downward; aligned cylinder walls each extending vertically between the upper and lower deck portions, the cylinder walls having cylinder bores defined therein respectively; jacket side walls respectively surrounding the cylinder walls so that a water jacket is defined between each jacket side wall and the corresponding cylinder wall; jacket bottom walls each extending between a vertically lowermost end of each jacket side wall and a vertically middle part of the corresponding cylinder wall, the jacket bottom walls being positioned above the lower deck portion; a front wall that constitutes an axial end wall of the cylinder block, the front wall being integral with a front part of the upper deck portion, a front part of the lower deck portion, a front one of the cylinder walls, a front one of the jacket side walls and a front one of the jacket bottom walls; and a reinforcing structure integrally formed on the front wall for reinforcing an entire construction of the cylinder block, the reinforcing structure including mutually crossing vertical and lateral ribs, the vertical rib extending between the upper deck portion and the lower deck portion along an imaginary plane on which axes of the cylinder bores lie, and the lateral rib constituting a raised ridge of the front one of the jacket bottom walls.

In accordance with a third aspect of the present invention, there is provided a cylinder block of an internal combustion engine, which comprises an upper deck portion on which a cylinder head is to be mounted; a lower deck portion from which a crank case extends downward; aligned cylinder walls each extending vertically between the upper and lower deck portions, the cylinder walls having cylinder bores defined therein respectively; jacket side walls respectively surrounding the cylinder walls so that a water jacket is defined between each jacket side wall and the corresponding cylinder wall; jacket bottom walls each extending between a vertically lowermost end of each jacket side wall and a vertically middle part of the corresponding cylinder wall, the jacket bottom walls being positioned above the lower deck portion; a front wall that constitutes an axial end wall of the cylinder block, the front wall being integral with a front part of the upper deck portion, a front part of the lower deck portion, a front one of the cylinder walls, a front one of the jacket side walls and a front one of the jacket bottom walls; and a reinforcing structure integrally formed on the front wall for reinforcing an entire construction of the cylinder block, the reinforcing structure comprises a raised bolt boss that is integrally formed on the front one of the jacket bottom walls to catch a connecting bolt used for securing a middle portion of a front cover to the front wall, the raised bolt boss being positioned on an imaginary plane on which respective axes of the cylinder bores lie.

DETAILED DESCRIPTION OF THE INVENTION

Figure 1:
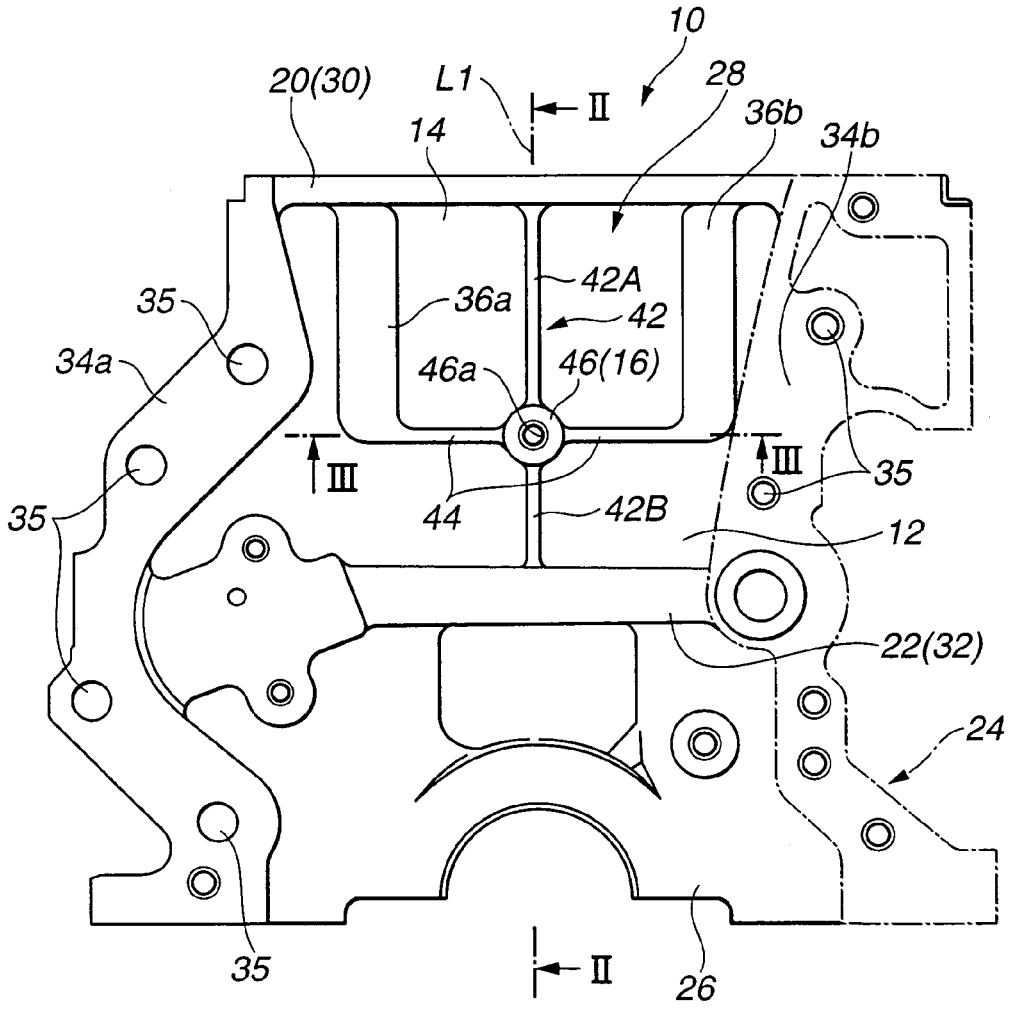
FIG. 1 is a front view of a cylinder block of an internal combustion engine, according to the present invention.
Figure 2:
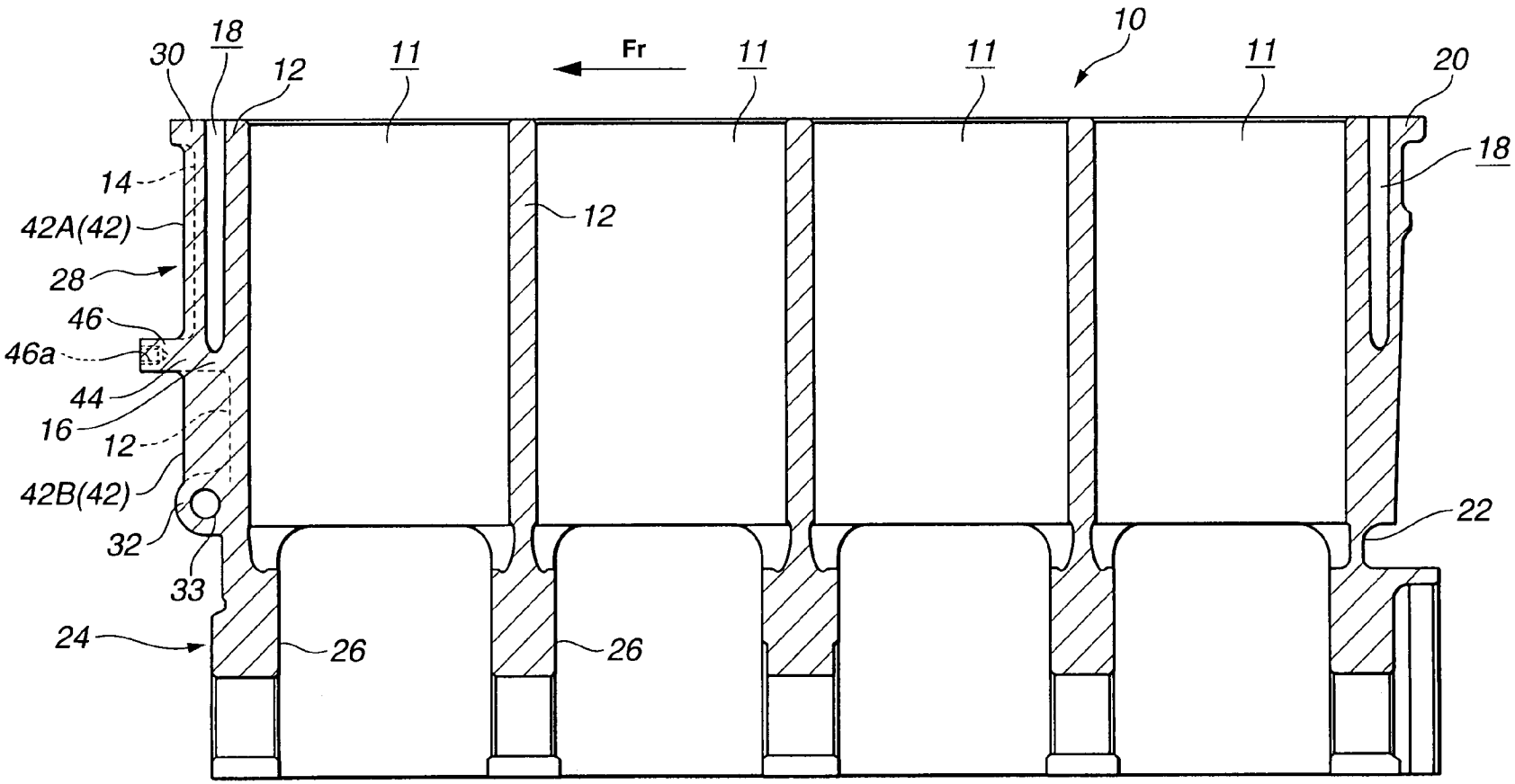
FIG. 2 is a sectional view taken along the line "II—II" of FIG. 1.

Referring to the drawings, particularly FIGS. 1 and 2, there is shown a cylinder block 10 of an internal combustion engine, which is the present invention. The engine to which cylinder block 10 is practically applied is of an in-line four cylinder water cooled type. In use, the engine is transversely mounted in an engine room of a vehicle body with its intake side facing forward and its exhaust side facing backward.

Cylinder block 10 is constructed of a die-cast aluminum alloy or the like.

Figure 3:
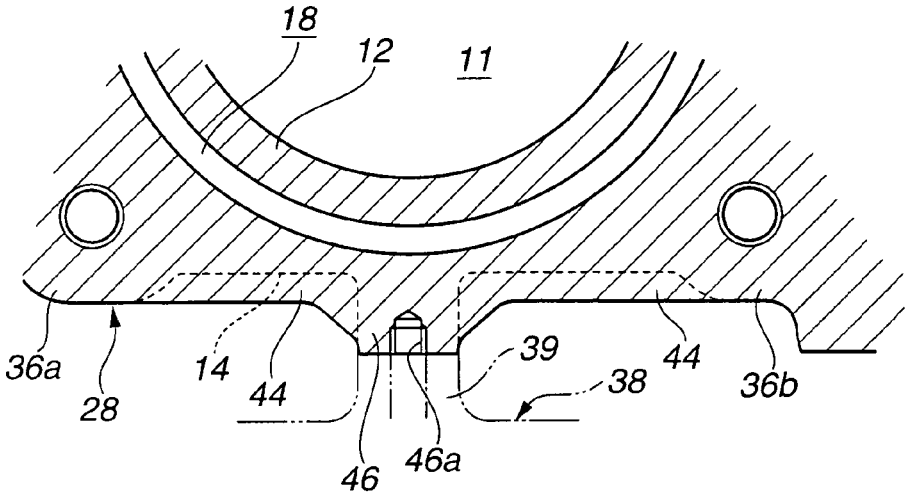
FIG. 3 is a sectional view taken along the line "III—III" of FIG. 1.

As is seen from FIGS. 2 and 3, cylinder block 10 is of a so-called open deck type having a water jacket 18 defined therein, of which upper end is largely exposed to an upper deck portion 20 of cylinder block 10.

As is understood from FIGS. 2 and 3, in cylinder block 10, there are formed four cylinders (or cylinder bores) 11 which are aligned. Although not shown, a piston is operatively disposed in each of cylinders 11.

Each cylinder 11 is defined by a cylindrical cylinder wall 12.

As is understood from FIG. 2, a generally upper half of each cylinder wall 12 is surrounded by a cylindrical jacket side wall 14 leaving therebetween water jacket 18. As is known, heat of cylinder walls 12 produced as a result of combustion of air/fuel mixture in combustion chambers of cylinders 11 is absorbed by cooling water that is forced to flow in water jacket 18.

In order to reduce an axial length of cylinder block 10, a so-called siamesed arrangement is employed wherein mutually adjacent parts of neighboring cylinder walls 12 are merged to with another.

As is seen from FIG. 2, each cylinder wall 12 extends vertically between the above-mentioned upper deck portion 20 and a lower deck portion 22.

As is seen from FIGS. 1 and 2, from lower deck portion 22, there extends downward a crank case 24. As is known, crank case 24 comprises a plurality of bearing cap mounting walls 26 that rotatably support a crankshaft with the aid of bearing caps (not shown).

As is understood from FIG. 2, on upper deck portion 20, there is tightly mounted a cylinder head (not shown) with a cylinder head gasket hermetically put therebetween. For this tight mounting, a plurality of head bolts (not shown) are used.

A jacket bottom wall 16 defining therein a bottom surface of water jacket 18 extends between a lower end of each jacket side wall 14 and a middle portion of the corresponding cylinder wall 12. With this, jacket bottom wall 16 is positioned above lower deck portion 22, so that water jacket 18 is formed about only an upper part of each cylinder wall 12. That is, the shallow bottom water jacket 18 is provided.

Due to this construction of water jacket 18, the upper portion of cylinder wall 12 near a combustion chamber is effectively cooled by cooling water, and due to absence of water jacket around the lower part of cylinder wall 12, weight reduction of cylinder block 10 is possible. Of course, other advantages such as suppression of over cooling, improvement in fuel consumption, improvement in exhaust characteristics, improvement in heating characteristics of heating system, etc., are also obtainable.

As is seen from FIGS. 1 and 2, to a front wall 28 of cylinder block 10 to which a front cover 38 (see FIG. 4) is to be fixed, there are exposed a front part of upper deck portion 20, a front part of lower deck portion 22, a front one of cylinder walls 12, a front one of jacket side walls 14 and a front one of jacket bottom walls 16. That is, front wall 28 is substantially constructed by the front part of upper deck portion 20, the front part of lower deck portion 22, the front one of cylinder walls 12, the front one of jacket side walls 14 and the front one of jacket bottom walls 16.

It is to be noted that when the corresponding engine is transversely installed in the engine room, front wall 28 of cylinder block 10 faces leftward with respect to the vehicle.

As is seen from FIGS. 1 and 2, to front wall 28 of cylinder block 10, there are also exposed an upper deck flange 30 that extends along upper deck portion 20, a lower deck flange 32 that extends along lower deck portion 22, a cover mounting left flange 34*a* that extends along a left periphery of cylinder block 10, a cover mounting right flange 34*b* that extends along a right periphery of cylinder block 10, and left and right head bolt bosses 36*a* and 36*b* that are provided for catching the above-mentioned head bolts.

Cover mounting left and right flanges 34*a* and 34*b* are formed with a plurality of threaded bolt openings 35 for connecting a peripheral portion of front cover 38 thereto by means of connecting bolts (not shown).

As is seen from FIG. 2, lower deck flange 32 is formed with a water passage 33 that is communicated with the above-mentioned water jacket 18. Due to provision of such water passage 33, lower deck flange 32 is expanded to have a rounded outer surface, as shown. If desired, such water passage 33 may be removed from lower deck flange 32.

Front cover 38 (see FIG. 4) is constructed of a die-cast aluminum alloy or the like. As shown, front cover 38 is formed with a plurality of bolt openings 38*b* at its peripheral flange portion 38*a*. That is, the above-mentioned connecting bolts pass through bolt openings 38*b* for securing front cover 38 to front wall 28 of cylinder block 10.

As is best seen from FIG. 1, front wall 28 of cylinder block 10 is integrally formed with a reinforcing structure for reinforcing an entire construction of cylinder block 10.

The reinforcing structure comprises a vertical rib 42 and a lateral rib 44 which are arranged to cross at generally right angles.

As shown, vertical rib 42 is arranged at an upper half area of front wall 28 and extends vertically along an imaginary plane "L1" on which the axes of the four cylinders 11 lie.

Vertical rib 42 has an upper end merged with a front edge of upper deck flange 30 and a lower end merged with a front edge of lower deck flange 32. That is, vertical rib 42 extends vertically between the front edge of upper deck flange 30 and that of lower deck flange 32.

As is understood from FIGS. 1 and 2, lateral rib 44 is arranged at the upper half area of front wall 28 and extends laterally along the front one of jacket bottom walls 16. That is, lateral rib 44 constitutes a raised ridge of the front one of jacket bottom walls 16.

As is seen from FIG. 1, lateral rib 44 has a left end merged with left head bolt boss 36*a* and a right end merged with right head bolt boss 36*b*.

As is seen from FIG. 2, at the area of front wall 28, jacket side wall 14 projects beyond cylinder wall 12, and vertical rib 42 has a common top ridge throughout the length thereof. Thus, an upper part 42A of vertical rib 42 that is arranged on jacket side wall 14 has a smaller projection degree from jacket wall 15 and a lower part 42B of vertical rib 42 that is arranged on the lower portion of cylinder wall 12 has a larger projection degree from cylinder wall 12.

As is best seen from FIG. 1, at the portion of front wall 28 where vertical rib 42 and lateral rib 44 cross, there is integrally formed a bolt boss 46 that has a threaded bolt opening 46*a*.

Figure 4:
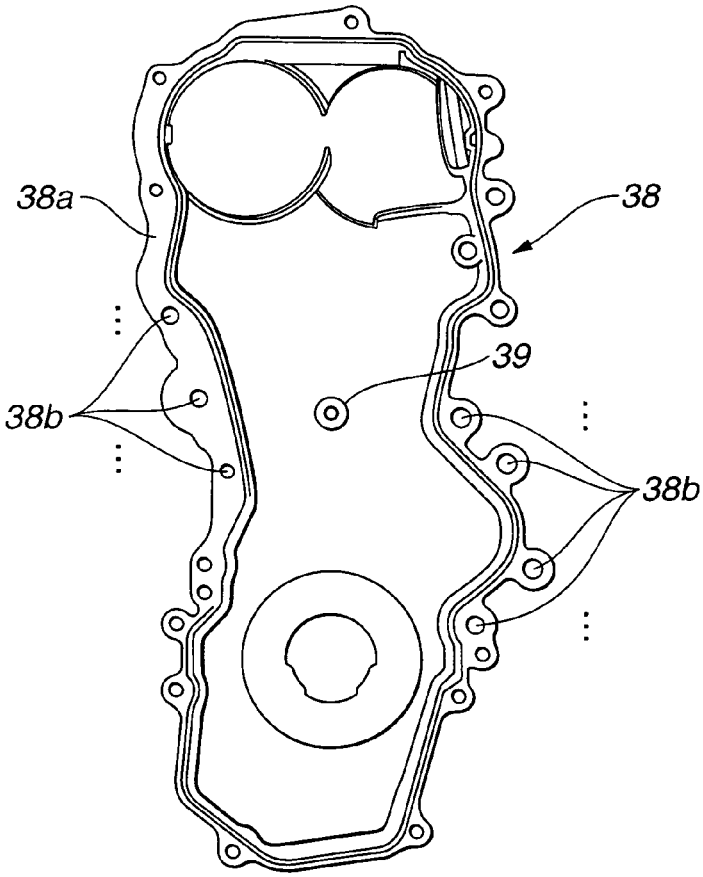
FIG. 4 is a back view a front cover that is to be fixed to a front wall of the cylinder block.

As is understood from FIGS. 1, 3 and 4, when front cover 38 is fixed to front wall 28 of cylinder block 10, a center bolt (not shown) passing through a center bolt boss opening 39 of front cover 38 is engaged with threaded bolt opening 46*a* of bolt boss 46 of front wall 28. Preferably, bolt boss 46 is cylindrical in shape and has a larger size and thickness.

In the following, various advantages provided by the present invention will be described.

In the present invention, reinforcing structure is provided by front wall 28 of cylinder block 10. That is, due to provision of vertical rib 42 and lateral rib 44 which cross at generally right angles, the rigidity of front wall 28 and thus that of cylinder block 10 is remarkably increased. Thus, undesired deformation of cylinder wall 12 and that of front wall 28 are assuredly suppressed.

Since lateral rib 44 is constructed to constitute the ridge of the front one of jacket bottom walls 16, jacket bottom wall 16 where a stress is concentrated under operation of the engine can have a satisfied rigidity. Thus, undesired deformation of jacket bottom wall 16 and thus that of cylinder wall 12 are suppressed.

In the present invention, the upper end of vertical rib 42 is merged with upper deck flange 30, which increases the rigidity of upper deck flange 30. Thus, undesired deformation of upper deck flange 30, which would be caused by a strong resiliency of a cylinder head gasket hermetically put between cylinder head 10 and a cylinder head (not shown), is assuredly suppressed.

In the invention, the center portion of front cover 38 is tightly bolted to bolt boss 46 of front wall 28 of cylinder block 10 in addition to the bolting of the peripheral portion thereof to front wall 28 of cylinder block 10. Accordingly, undesired vibration of front cover 38 is assuredly suppressed.

Bolt boss 46 is provided by making good use of the crossing part between vertical rib 42 and lateral rib 44. This brings about a simpler construction of cylinder block 10 as compared with a conventional case wherein such bolt boss (46) is independently raised from front wall 28.

In the invention, vertical rib 42 extends between upper deck flange 30 and lower deck flange 32 and lateral rib 44 extends between left head bolt boss 36*a* and right head bolt boss 36*b*. Thus, a so-called grid shaped reinforcing structure is provided by front wall 28 of cylinder block 10, which assuredly provides front wall 28 with a satisfied rigidity against the stress concentration.

Although the foregoing description is directed to the in-line four cylinder water cooler type internal combustion engine, the present invention is applicable to other type internal combustion engines such as in-line three cylinder engine, in-line five cylinder engine, in-line six cylinder engine, in-line seven cylinder engine, in-line eight cylinder engine and the like.

The entire contents of Japanese Patent Application 2003-351586 filed Oct. 10, 2003 are incorporated herein by reference.

Although the invention has been described above with reference to the embodiment of the invention, the invention is not limited to such embodiment as described above. Various modifications and variations of such embodiment may be carried out by those skilled in the art, in light of the above description.

What is claimed is:

1. A cylinder block of an internal combustion engine, comprising:

an upper deck portion on which a cylinder head is to be mounted;

a lower deck portion from which a crank case extends downward;

aligned cylinder walls each extending vertically between the upper and lower deck portions, the cylinder walls having cylinder bores defined therein respectively;

jacket side walls respectively surrounding the cylinder walls so that a water jacket is defined between each jacket side wall and the corresponding cylinder wall;

jacket bottom walls each extending between a vertically lowermost end of each jacket side wall and a vertically middle part of the corresponding cylinder wall, the jacket bottom walls being positioned above the lower deck portion;

a front wall that constitutes an axial end wall of the cylinder block, the front wall being integral with a front part of the upper deck portion, a front part of the lower deck portion, a front one of the cylinder walls, a front one of the jacket side walls and a front one of the jacket bottom walls; and a reinforcing structure integrally formed on the front wall for reinforcing an entire construction of the cylinder block, the reinforcing structure being of a type that is raised from a major surface of the front wall;

wherein the reinforcing structure comprises mutually crossing vertical and lateral ribs, the vertical rib extending between the upper deck portion and the lower deck portion, and the lateral rib forming a raised ridge of the front one of the jacket bottom walls.

2. A cylinder block as claimed in claim 1, in which the reinforcing structure further comprises two head bolt bosses that are integrally formed on the front wall, each head bolt boss being constructed to catch a head bolt used for securing the cylinder head to the upper deck portion.

3. A cylinder block as claimed in claim 2, in which the head bolt bosses have respective lower ends between which the lateral rib extends.

4. A cylinder block as claimed in claim 1, in which the vertical and lateral ribs have at their crossing portion a bolt boss that is constructed to catch a connecting bolt used for securing a middle portion of a front cover to the front wall.

5. A cylinder block as claimed in claim 4, in which the front wall is formed at its peripheral portion with a plurality of bolt openings that are constructed to catch connecting bolts used for securing a peripheral portion of the front cover to the front wall.

6. A cylinder block as claimed in claim 1, in which the vertical rib extends vertically along an imaginary plane on which axes of the cylinder bores lie.

7. A cylinder block as claimed in claim 1, in which the reinforcing structure comprises a raised bolt boss that is integrally formed on the front one of the jacket bottom walls to catch a connecting bolt used for securing a middle portion of a front cover to the front wall.

8. A cylinder block as claimed in claim 7, in which the raised bolt boss is positioned on an imaginary plane on which respective axes of the cylinder bores lie.

9. A cylinder block as claimed in claim 8, in which the raised bolt boss is arranged to connect a generally middle portion of a front cover thereto by means of a connecting bolt.

10. A cylinder block of an internal combustion engine, comprising:

an upper deck portion on which a cylinder head is to be mounted;

a lower deck portion from which a crank case extends downward;

aligned cylinder walls each extending vertically between the upper and lower deck portions, the cylinder walls having cylinder bores defined therein respectively;

jacket side walls respectively surrounding the cylinder walls so that a water jacket is defined between each jacket side wall and the corresponding cylinder wall;

jacket bottom walls each extending between a vertically lowermost end of each jacket side wall and a vertically middle part of the corresponding cylinder wall, the jacket bottom walls being positioned above the lower deck portion;

a front wall that constitutes an axial end wall of the cylinder block, the front wall being integral with a front part of the upper deck portion, a front part of the lower deck portion, a front one of the cylinder walls, a front one of the jacket side walls and a front one of the jacket bottom walls; and a reinforcing structure integrally formed on the front wall for reinforcing an entire construction of the cylinder block, the reinforcing structure including mutually crossing vertical and lateral ribs, the vertical rib extending between the upper deck portion and the lower deck portion along an imaginary plane on which axes of the cylinder bores lie, and the lateral rib constituting a raised ridge of the front one of the jacket bottom walls.

11. A cylinder block of an internal combustion engine, comprising:

an upper deck portion on which a cylinder head is to be mounted;

a lower deck portion from which a crank case extends downward;

aligned cylinder walls each extending vertically between the upper and lower deck portions, the cylinder walls having cylinder bores defined therein respectively;

jacket side walls respectively surrounding the cylinder walls so that a water jacket is defined between each jacket side wall and the corresponding cylinder wall;

jacket bottom walls each extending between a vertically lowermost end of each jacket side wall and a vertically middle part of the corresponding cylinder wall, the jacket bottom walls being positioned above the lower deck portion;

a front wall that constitutes an axial end wall of the cylinder block, the front wall being integral with a front part of the upper deck portion, a front part of the lower deck portion, a front one of the cylinder walls, a front one of the jacket side walls and a front one of the jacket bottom walls; and a reinforcing structure integrally formed on the front wall for reinforcing an entire construction of the cylinder block, the reinforcing structure comprises a raised bolt boss that is integrally formed on the front one of the jacket bottom walls to catch a connecting bolt used for securing a middle portion of a front cover to the front wall, the raised bolt boss being positioned on an imaginary plane on which respective axes of the cylinder bores lie.

* * * * *